US008820770B2

(12) United States Patent
Speirer

(10) Patent No.: US 8,820,770 B2
(45) Date of Patent: Sep. 2, 2014

(54) SKI, SNOWBOARD, OR MONOBOARD WITH DEPTH INDICATOR

(71) Applicant: Paul Speirer, Reno, NV (US)

(72) Inventor: Paul Speirer, Reno, NV (US)

( * ) Notice: Subject to any disclaimer, the term of this patent is extended or adjusted under 35 U.S.C. 154(b) by 0 days.

(21) Appl. No.: 13/651,356

(22) Filed: Oct. 12, 2012

(65) Prior Publication Data

US 2013/0093164 A1 Apr. 18, 2013

Related U.S. Application Data

(60) Provisional application No. 61/546,472, filed on Oct. 12, 2011.

(51) Int. Cl.
*A63C 5/00* (2006.01)

(52) U.S. Cl.
USPC ..... 280/610; 280/600; 280/809

(58) Field of Classification Search
USPC ..... 280/602, 610, 609, 607, 14.22, 809, 280/600; 36/99, 31
See application file for complete search history.

(56) References Cited

U.S. PATENT DOCUMENTS

| | | | | |
|---|---|---|---|---|
| 4,715,612 | A | 12/1987 | Fels et al. | |
| 5,394,626 | A * | 3/1995 | Brown | 36/99 |
| 5,573,264 | A | 11/1996 | Deville et al. | |
| 5,782,482 | A * | 7/1998 | Andrus et al. | 280/602 |
| 5,894,682 | A * | 4/1999 | Broz | 36/31 |
| 5,988,668 | A * | 11/1999 | DeVille et al. | 280/602 |
| 6,207,897 | B1 * | 3/2001 | Reiker | 174/58 |
| 6,217,041 | B1 * | 4/2001 | Hauser et al. | 280/602 |
| 6,380,871 | B1 * | 4/2002 | Kaplan | 340/984 |
| 6,520,530 | B1 * | 2/2003 | Dodge et al. | 280/610 |
| 6,585,017 | B1 * | 7/2003 | Campbell et al. | 144/117.1 |
| 6,612,605 | B2 * | 9/2003 | Andrus et al. | 280/610 |
| 6,821,052 | B2 * | 11/2004 | Zurn | 404/84.5 |
| 6,886,848 | B2 * | 5/2005 | Riepler | 280/602 |
| 7,757,733 | B2 * | 7/2010 | Liao | 144/117.1 |

* cited by examiner

*Primary Examiner* — Hau Phan
(74) *Attorney, Agent, or Firm* — Lewis Roca Rothgerber LLP

(57) ABSTRACT

A ski, snowboard, or monoboard includes a base layer having a top surface and a bottom surface, a blade disposed on an outer edge of the top surface of the base layer, a lower body layer disposed on the top surface of the base layer and the blade, a core disposed on the lower body layer, an upper body layer disposed on the core, and a depth indicator disposed in the base layer and extending inward from the bottom surface of the base layer. The depth indicator has a visually perceivable characteristic that varies as a function of depth in the base layer.

18 Claims, 5 Drawing Sheets

SKI, SNOWBOARD, OR MONOBOARD WITH DEPTH INDICATOR

CROSS-REFERENCE TO RELATED APPLICATION

This application claims the benefit of U.S. Provisional Application No. 61/546,472, filed Oct. 12, 2011.

BACKGROUND OF THE INVENTION

1. Field of the Invention

The present invention relates to a ski, snowboard, or monoboard. More particularly, the present invention relates to a ski, snowboard, or monoboard that includes a visually perceivable depth indicator.

2. The Prior Art

Skis, snowboards, and monoboards are known in the prior art. Nearly 23 million ski, snowboard, and monoboard riders take to the slopes in the United States every year. Because these riders constantly seek increasingly exhilarating riding experiences, a majority of the prior art teaches inventions that focus on improving performance-related design parameters (e.g., U.S. Pat. Nos. 4,715,612 and 5,573,264).

Notably, however, the prior art largely neglects improvements that relate to assessing equipment lifespan. Almost all skis, snowboards, and monoboards are constructed using similar materials and manufacturing processes. Additionally, all ski, snowboard, and monoboard designs include a base layer. The base layer is the part of the equipment that makes contact with the ground during normal use. As a rider uses a ski, snowboard, or monoboard, the base layer naturally suffers minor damage from rocks or other debris. As a result, it needs to be serviced. The servicing process typically entails restoring the base layer's smooth service through sanding or similar methods. With existing ski, snowboard, and monoboard designs, it is difficult to visually detect how much of the base layer has already been reduced during previous sessions. Accordingly, it is possible to mistakenly remove too much of the base layer. The skis, snowboards, and monoboards that are taught in the prior art fail to this problem.

BRIEF DESCRIPTION OF THE INVENTION

According to the present invention, a ski, snowboard, or monoboard includes a base layer having a top surface and a bottom surface, a blade disposed on an outer edge of the top surface of the base layer, a lower body layer disposed on the top surface of the base layer and the blade, a core disposed on the lower body layer, an upper body layer disposed on the core, and a depth indicator disposed in the base layer and extending inward from the bottom surface of the base layer. The depth indicator includes a visually perceivable characteristic that varies as a function of depth in the base layer.

According to a first aspect of the present invention, the depth indicator comprises a colored region that is disposed in the base layer. For purposes of this disclosure, the term "color" includes white, gray, and black, in addition to all colors within the visible light spectrum. The colored region comprises multiple layers—an exposed layer that is disposed on the bottom surface of the base layer, and several inner layers that are disposed within the base layer below the exposed layer. The layers vary from one another in color density such that the color density of the exposed layer varies as a function of depth in the base layer. Specifically, as the base layer is reduced, the exposed layer becomes thinner and gradually reveals the next underlying inner layer. Because each subsequently exposed layer has a different color density, the user can visually perceive changes in the depth of the base layer as it is gradually reduced. According to a second aspect of the present invention, the layers vary from one another in color such that the color of the exposed layer varies as a function of depth in the base layer.

According to a third aspect of the present invention, the depth indicator comprises a tapered groove that is disposed in the base layer such its volume varies as a function of depth in the base layer. As the base layer is gradually reduced, the volume of the tapered groove changes. Accordingly, the user can visually perceive changes in the depth of the base layer as it is gradually reduced.

According to a fourth aspect of the present invention, the depth indicator comprises a tapered plug that has an outer surface disposed on the bottom surface of the base layer and an inner surface disposed within the base layer. The tapered plug is disposed such that the surface area of the outer surface of the tapered plug varies as a function of depth in the base layer. As the base layer is gradually reduced, the surface area of the tapered plug changes. Accordingly, the user can visually perceive changes in the depth of the base layer as it is gradually reduced.

DETAILED DESCRIPTION OF THE INVENTION

Persons of ordinary skill in the art will realize that the following description of the present invention is illustrative only and is not in any way limiting. Other embodiments of the invention will readily suggest themselves to such skilled persons.

Figure 1A:
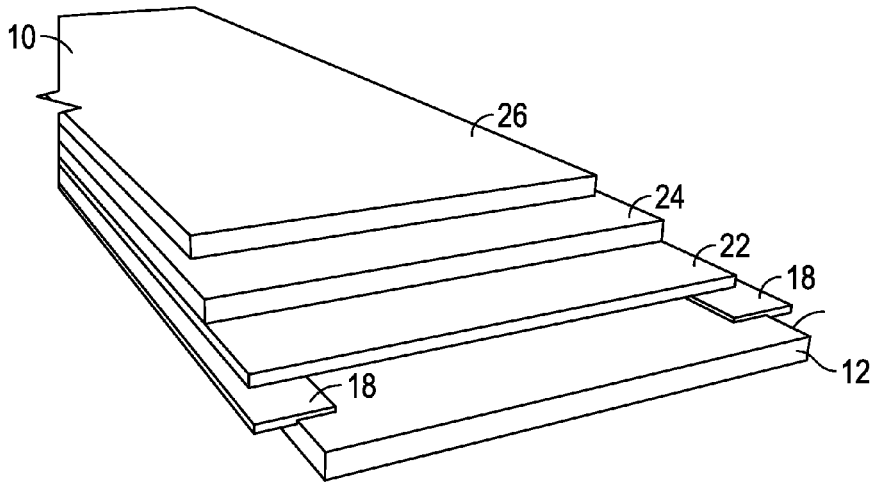
FIG. 1A is an angled cross-sectional view (oriented with the base layer at the bottom of the figure) of a ski, snowboard, or monoboard according to an exemplary embodiment of the present invention.
Figure 1B:
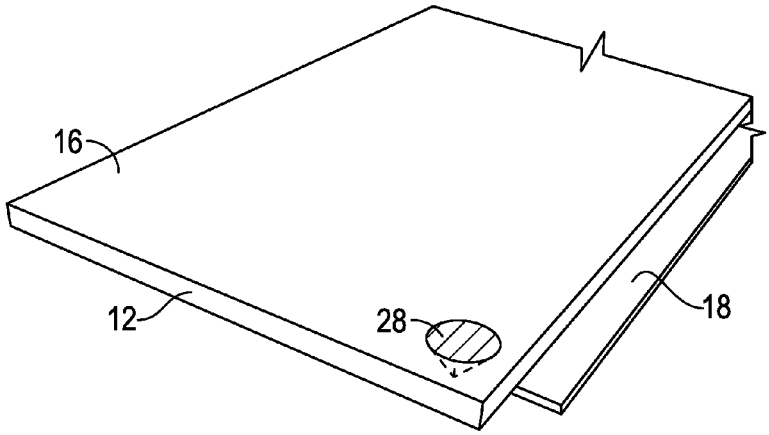
FIG. 1B is an angled cross-sectional view (oriented with the base layer at the top of the figure) of a ski, snowboard, or monoboard according to an exemplary embodiment of the present invention.

Referring first to FIGS. 1A and 1B, in one exemplary embodiment a ski, snowboard, or monoboard 10 includes a base layer 12 having a top surface 14 and a bottom surface 16, a blade 18 disposed on an outer edge 20 of the top surface 14 of the base layer 12, a lower body layer 22 disposed on the top surface 14 of the base layer 12 and the blade 18, a core 24 disposed on the lower body layer 22, an upper body layer 26 disposed on the core 24, and a depth indicator 28 disposed in the base layer 12 and extending inward from the bottom surface 16 of the base layer 12. The depth indicator 28 includes a visually perceivable characteristic that varies as a function of depth in the base layer 12. The ski, snowboard, or monoboard 10 may be manufactured using materials and methods that are commonly known to persons of ordinary skill in the art (e.g., by cutting, extruding, or sintering components and then affixing them in place with resin, epoxy, or other adhesive materials that are commonly known to persons of ordinary skill in the art).

Figure 2:
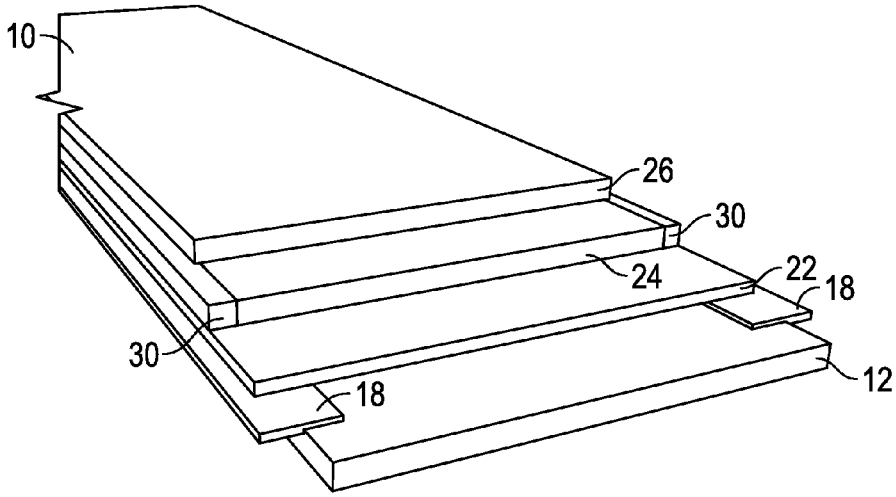
FIG. 2 is an angled cross-sectional view (oriented with the base layer at the bottom of the figure) of a ski, snowboard, or monoboard according to an exemplary embodiment of the present invention that includes a plurality of sidewalls.

Referring now to FIG. 2, in another exemplary embodiment, a ski, snowboard, or monoboard 10 further includes a plurality of sidewalls 30 disposed on the lower body layer 22 adjacent to the core 24.

Figure 3:
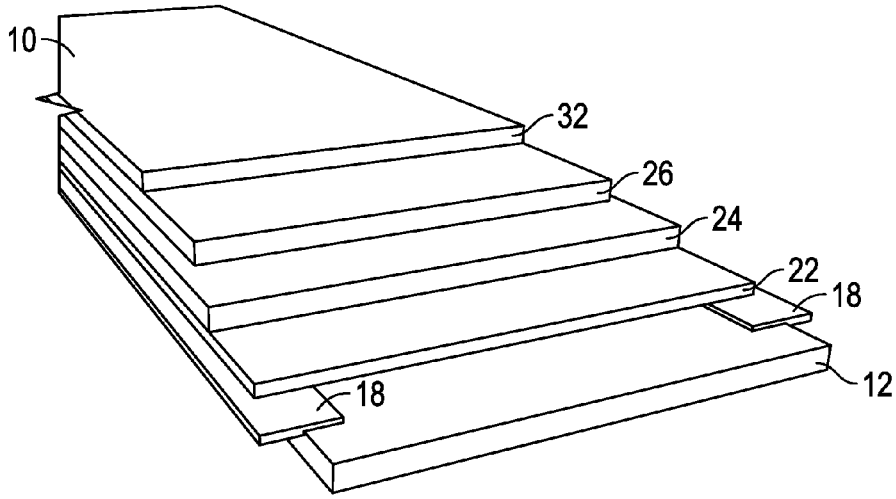
FIG. 3 is an angled cross-sectional view (oriented with the base layer at the bottom of the figure) of a ski, snowboard, or monoboard according to an exemplary embodiment of the present invention that includes a topsheet.

Referring now to FIG. 3, in yet another exemplary embodiment, a ski, snowboard, or monoboard 10 further includes a topsheet 32 disposed on the upper body layer 26.

Figure 4:
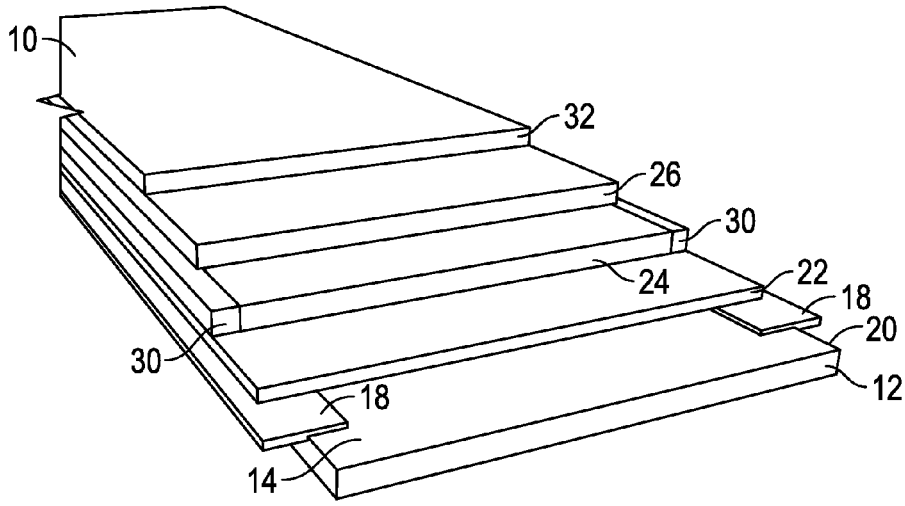
FIG. 4 is an angled cross-sectional view (oriented with the base layer at the bottom of the figure) of a ski, snowboard, or monoboard according to an exemplary embodiment of the present invention that includes a plurality of sidewalls and a topsheet.

Referring now to FIG. 4, in yet another exemplary embodiment, a ski, snowboard, or monoboard 10 further includes a plurality of sidewalls 30 disposed on the lower body layer 22 adjacent to the core 24 and a topsheet 32 disposed on the upper body layer 26.

In an illustrative embodiment, the base layer 12 comprises high molecular weight polyethylene. Moreover, in one exemplary embodiment, the base layer 12 is extruded. In another such embodiment, the base layer 12 is sintered.

In one representative embodiment, the blade 18 comprises metal. Additionally, in an exemplary embodiment, the blade 18 is disposed on the outer edge 20 of the top surface 14 of the base layer 12 such that the blade 18 wraps circumferentially around the outer edge 20 of the top surface 14 of the base layer 12. In yet another exemplary embodiment, the blade 18 is disposed on the outer edge 20 of the top surface 14 of the base layer 12 such that the blade 18 does not wrap circumferentially around the outer edge 20 of the top surface 14 of the base layer 12.

In an illustrative embodiment, the lower body layer 22 and upper body layer 26 comprise fiberglass. In one exemplary embodiment, the fiberglass is bi-axially wrapped. In another exemplary embodiment, the fiberglass is tri-axially wrapped.

In several exemplary embodiments, the core 24 comprises wood, foam, carbon fiber, a plurality of hollow aluminum cells, Kevlar® synthetic fiber, or a composite material, respectively.

Moreover, in several exemplary embodiments, the plurality of sidewalls 30 comprise plastic, rubber, wood, metal, or a composite material, respectively. In several exemplary embodiments, the topsheet 32 comprises nylon, wood, fiberglass, plastic, or a composite material, respectively.

Figure 5:
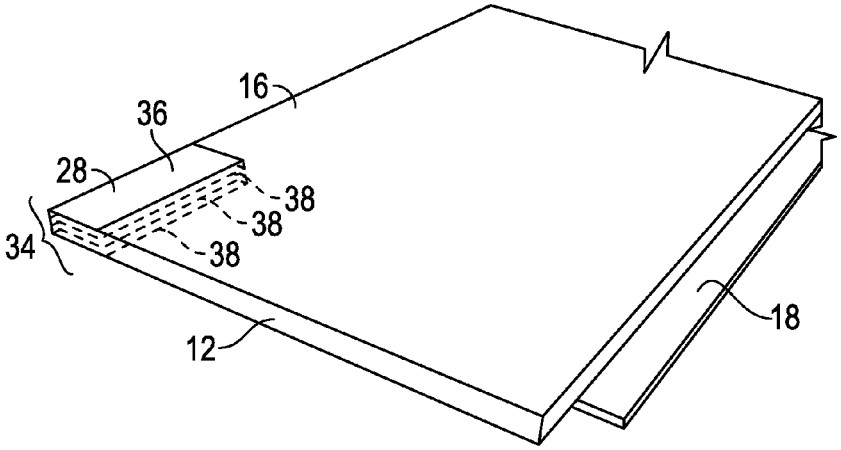
FIG. 5 is an angled cross-sectional view (oriented with the base layer at the top of the figure) of a ski, snowboard, or monoboard according to an exemplary embodiment of the present invention wherein the depth indicator comprises a colored region disposed in the base layer.

Referring now to FIG. 5, in one exemplary embodiment, the depth indicator 28 comprises a colored region 34 disposed in the base layer 12, the colored region 34 having an exposed layer 36 disposed on the bottom surface 16 of the base layer 12 and a plurality of inner layers 38 disposed within the base layer 12 below the exposed layer 36. For purposes of this disclosure, the term "color" includes white, gray, and black, in addition to all colors within the visible light spectrum. The exposed layer 36 and the plurality of inner layers 38 vary from one another in color density such that the characteristic that varies as a function of depth in the base layer 12 is the color density of the exposed layer 36. As the base layer 12 is gradually reduced, the color density of the colored region 34 changes as the exposed layer 36 becomes thinner and the underlying inner layers 38 are individually revealed over time. In one exemplary embodiment, as shown in FIG. 5, the color density of the exposed layer 36 decreases as the base layer 12 is gradually reduced. In another exemplary embodiment, the color density of the exposed layer 36 increases as the base layer 12 is gradually reduced. In one exemplary embodiment, the colored region 34 may be achieved by varying the amount of time that the exposed layer 36 and inner layers 38 are sublimated with colors or graphics. Persons of ordinary skill in the art will readily recognize that there are other commonly known methods for creating the colored region 34.

In another illustrative embodiment, the exposed layer 36 and the plurality of inner layers 38 vary from one another in color such that the characteristic that varies as a function of depth in the base layer 12 is the color of the exposed layer 36. As the base layer 12 is gradually reduced, the color of the colored region 34 changes as the exposed layer 36 becomes thinner and the underlying inner layers 38 are individually revealed over time. In these exemplary embodiments, the colored region 34 may incorporate solid colors, colors arranged in a pattern, or colors arranged to form an image. Persons of ordinary skill in the art will readily recognize that these embodiments are merely exemplary and that other possible embodiments of the colored region 34 exist and fall within the scope of the claimed invention.

Figure 6:
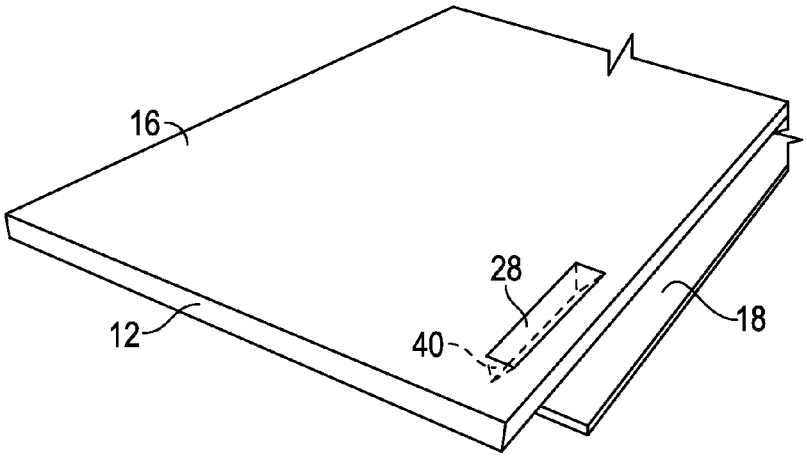
FIG. 6 is an angled cross-sectional view (oriented with the base layer at the top of the figure) of a ski, snowboard, or monoboard according to an exemplary embodiment of the present invention wherein the depth indicator comprises a tapered groove disposed in the base layer.

Referring now to FIG. 6, in yet another exemplary embodiment, the depth indicator 28 comprises a tapered groove 40 disposed in the base layer 12 such that the characteristic that varies as a function of depth in the base layer 12 is the volume of the tapered groove 40. As the base layer 12 is gradually reduced over time, the volume of the tapered groove 40 changes. This change signals to the user that part of the base layer 12 has been removed. In one exemplary embodiment, the tapered groove 40 may be achieved by machining the tapered groove 40 into the base layer 12. Persons of ordinary skill in the art will readily recognize that these embodiments are merely exemplary and that many other possible methods for creating the tapered groove 40 exist and fall within the scope of the claimed invention.

Figure 7A:
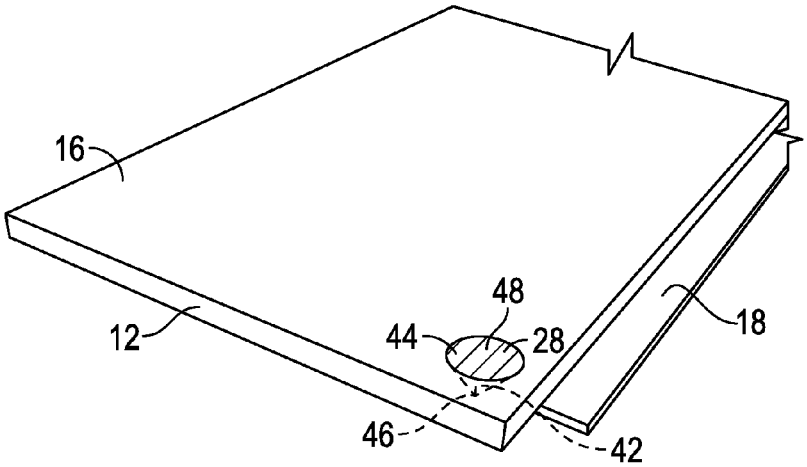
FIG. 7A is an angled cross-sectional view (oriented with the base layer at the top of the figure) of a ski, snowboard, or monoboard according to an exemplary embodiment of the present invention wherein the depth indicator comprises a tapered plug, the shape of which resembles a cone or other geometric shape, disposed in the base layer.

Referring now to FIG. 7A, in another exemplary embodiment, the depth indicator 28 comprises a tapered plug 42, the tapered plug 42 having an outer surface 44 disposed on the bottom surface 16 of the base layer 12 and an inner surface 46 disposed within the base layer 12, the tapered plug 42 disposed such that the characteristic that varies as a function of depth in the base layer 12 is the surface area of the outer surface 44 of the tapered plug 42.

Figure 7B:
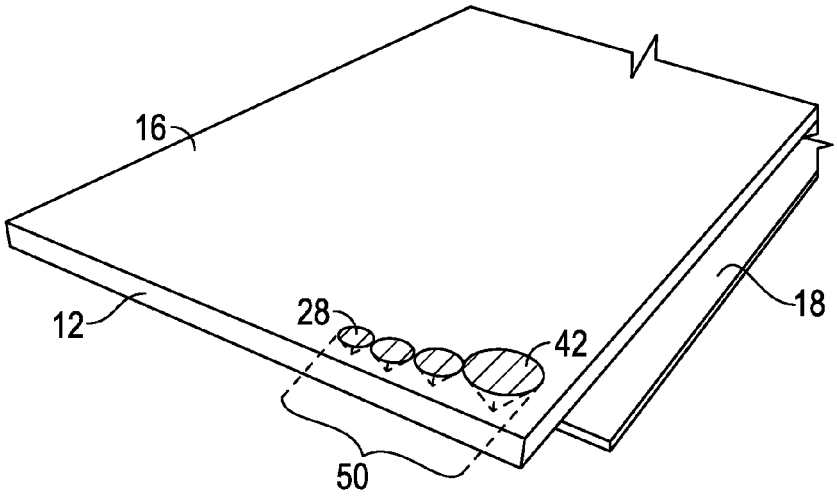
FIG. 7B is an angled cross-sectional view (oriented with the base layer at the top of the figure) of a ski, snowboard, or monoboard according to an exemplary embodiment of the present invention wherein the depth indicator comprises a tapered plug, the shape of which resembles a company logo or other image, disposed in the base layer.
Figure 7C:
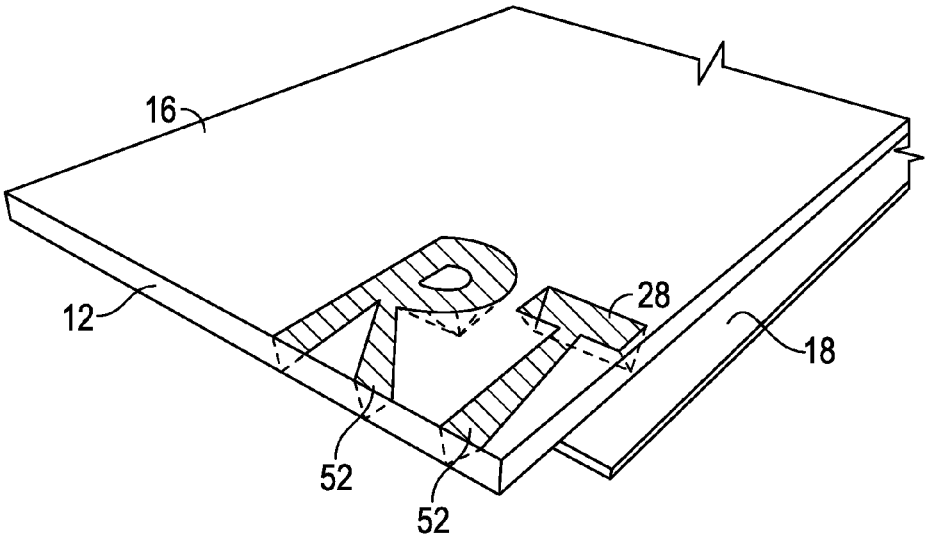
FIG. 7C is an angled cross-sectional view (oriented with the base layer at the top of the figure) of a ski, snowboard, or monoboard according to an exemplary embodiment of the present invention wherein the depth indicator comprises a tapered plug, the shape of which resembles letters, disposed in the base layer .

As shown in FIG. 7A, in one illustrative embodiment the shape of the tapered plug 42 resembles a geometric shape 48, such as cone. Referring now to FIG. 7B, in another illustrative embodiment the shape of the tapered plug 42 resembles an image 50, such as a company logo. In some embodiments, image 50 may comprise a plurality of tapered plugs 42 arranged together. Moreover, referring now to FIG. 7C, in yet another illustrative embodiment the shape of the tapered plug 42 resembles letters 52. In some embodiments, letters 52 may comprise a plurality of tapered plugs 42 arranged together. As the base layer 12 is gradually reduced over time, the surface area of the outer surface 44 of the tapered plug 42 changes. This change signals the user that part of the base layer 12 has been removed.

In one exemplary embodiment, the surface area of the outer surface 44 of the tapered plug 42 decreases as the base layer 12 is reduced. In another exemplary embodiment, the surface area of the outer surface 44 of the tapered plug 42 increases as the base layer 12 is reduced. Moreover, in one illustrative embodiment, the tapered plug 42 may be achieved by using a mold, die-cutter, or other method commonly known to persons of ordinary skill in the art. The tapered plug 42 may then be adhered into a corresponding slot that has been machined into the base layer 12. Persons of ordinary skill in the art will readily recognize that these embodiments are merely exemplary and that many other possible methods for creating the tapered plug 42 exist and fall within the scope of the claimed invention.

While embodiments and applications of this invention have been shown and described, it would be apparent to those skilled in the art that many more modifications than mentioned above are possible without departing from the inventive concepts discussed herein. The invention, therefore, is not to be restricted except in the spirit of the appended claims.

What is claimed is:

1. A ski, snowboard, or monoboard, comprising:

a base layer having a top surface and a bottom surface, wherein the base layer is composed of ultra high molecular weight polyethylene;

a blade disposed on an outer edge of the top surface of the base layer;

a lower body layer disposed on the top surface of the base layer and the blade;

a core disposed on the lower body layer;

an upper body layer disposed on the core; and a depth indicator disposed in the base layer and extending inward from the bottom surface of the base layer, the depth indicator having a visually perceivable characteristic that varies as a function of depth in the base layer.

2. The ski, snowboard, or monoboard of claim 1, further comprising a plurality of sidewalls disposed on the lower body layer adjacent to the core.

3. The ski, snowboard, or monoboard of claim 1 further comprising a topsheet disposed on the upper body layer.

4. The ski, snowboard, or monoboard of claim 3, wherein the topsheet comprises nylon.

5. The ski, snowboard, or monoboard of claim 3, wherein the topsheet comprises fiberglass.

6. The ski, snowboard, or monoboard of claim 3, wherein the topsheet comprises a composite material.

7. The ski, snowboard, or monoboard of claim 1, wherein the blade is disposed on the outer edge of the top surface of the base layer such that the blade wraps circumferentially around the outer edge of the top surface of the base layer.

8. The ski, snowboard, or monoboard of claim 1, wherein the blade is disposed on the outer edge of the top surface of the base layer such that the blade does not wrap circumferentially around the outer edge of the top surface of the base layer.

9. The ski, snowboard, or monoboard of claim 1, wherein the core comprises carbon fiber.

10. The ski, snowboard, or monoboard of claim 1, wherein the core comprises a plurality of hollow aluminum cells.

11. The ski, snowboard, or monoboard of claim 1, wherein the core comprises Kevlar® synthetic fiber.

12. The ski, snowboard, or monoboard of claim 1, wherein the depth indicator comprises a colored region disposed in the base layer, the colored region having an exposed layer disposed on the bottom surface of the base layer and a plurality of inner layers disposed within the base layer below the exposed layer, the exposed layer and the plurality of inner layers varying from one another in color density such that the characteristic that varies as a function of depth in the base layer is the color density of the exposed layer.

13. The ski, snowboard, or monoboard of claim 1, wherein the depth indicator comprises a colored region disposed in the base layer, the colored region having an exposed layer disposed on the bottom surface of the base layer and a plurality of inner layers disposed within the base layer below the exposed layer, the exposed layer and the plurality of inner layers varying from one another in color such that the characteristic that varies as a function of depth in the base layer is the color of the exposed layer.

14. The ski, snowboard, or monoboard of claim 1, wherein the depth indicator consists of a tapered groove disposed in the base layer such that the characteristic that varies as a function of depth in the base layer is the volume of the tapered groove.

15. The ski, snowboard, or monoboard of claim 1, wherein the depth indicator comprises a tapered plug, the tapered plug having an outer surface disposed on the bottom surface of the base layer and an inner surface disposed within the base layer, the tapered plug disposed such that the characteristic that varies as a function of depth in the base layer is the surface area of the outer surface of the tapered plug.

16. The ski, snowboard, or monoboard of claim 15, wherein the shape of the tapered plug resembles a geometric shape.

17. The ski, snowboard, or monoboard of claim 15, wherein the shape of the tapered plug resembles an image.

18. The ski, snowboard, or monoboard of claim 15, wherein the shape of the tapered plug resembles letters.

* * * * *